US005911561A

United States Patent [19]

Kathmann

[11] Patent Number: 5,911,561

[45] Date of Patent: Jun. 15, 1999

[54] RADIAL PUMP WITH STATIC ECCENTRIC AND ROTATABLE CYLINDERS

[75] Inventor: Peter B. Kathmann, Luxembourg, Luxembourg

[73] Assignee: Linear Anstalt, Liechtenstein

[21] Appl. No.: 08/860,795

[22] PCT Filed: Jan. 4, 1996

[86] PCT No.: PCT/EP96/00014

§ 371 Date: Sep. 8, 1997

§ 102(e) Date: Sep. 8, 1997

[87] PCT Pub. No.: WO96/21107

PCT Pub. Date: Jul. 11, 1996

[30] Foreign Application Priority Data

Jan. 5, 1995 [DE] Germany ..... 195 00 247
Feb. 10, 1995 [DE] Germany ..... 195 04 380

[51] Int. Cl.[6] ..... F04B 1/04

[52] U.S. Cl. ..... 417/273; 92/58

[58] Field of Search ..... 417/273, 415; 92/58

[56] References Cited

U.S. PATENT DOCUMENTS

| | | | |
|---|---|---|---|
| 3,345,916 | 10/1967 | Tobias | 92/58 |
| 4,975,025 | 12/1990 | Yamamura et al. | 417/273 |
| 5,547,348 | 8/1996 | Riley et al. | 417/273 |
| 5,752,427 | 5/1998 | Leutner | 91/497 |
| 5,848,565 | 12/1998 | Thoma | 91/491 |
| 5,848,879 | 12/1998 | Hanson | 417/521 |

FOREIGN PATENT DOCUMENTS

| | | |
|---|---|---|
| 526946 | 9/1956 | Belgium . |
| 0450586 | 10/1991 | European Pat. Off. . |
| 1155336 | 10/1963 | Germany . |
| 2359734 | 12/1974 | Germany . |
| 2331273 | 11/1980 | Germany . |
| 1936431 | 4/1981 | Germany . |
| 406853 | 8/1966 | Switzerland . |
| 506195 | 6/1939 | United Kingdom . |

*Primary Examiner*—Charles G. Freay
*Assistant Examiner*—Ehud Gartenberg
*Attorney, Agent, or Firm*—Ostrolenk, Faber, Gerb & Soffen, LLP

[57] ABSTRACT

A pump for conveying a medium, especially a gas-liquid mixture, with a housing, an annular surface extending inside the housing, an eccentric arranged off center in relation to the annular surface and at least one displacer arranged between the annular surface and the eccentric. The displacer is held in position in relation to the annular surface and the annular surface can rotate in relation to the eccentric. A hollow shaft delivers mixture to the eccentric which has connections to the displacer for delivering mixture to and receiving it from the displacer.

20 Claims, 7 Drawing Sheets

RADIAL PUMP WITH STATIC ECCENTRIC AND ROTATABLE CYLINDERS

BACKGROUND OF THE INVENTION

The present invention relates to a pump for conveying a medium, in particular a gas-liquid mixture, and particularly to the structure of the eccentric controlled pumping elements.

From the state of the art many different types of pumps are known. Radial piston pumps, for example, have a cylinder block that lies off-center inside a housing. In the cylinder block, pistons are arranged radially which, during the turning of the cylinder block, execute a stroke movement. Normally the pistons are supported in the housing by rollers.

Such radial piston pumps have the disadvantage that their construction, in particular the guiding of the pistons in the cylinder block is relatively complicated. In addition, such pumps pose problems when conveying gas-liquid mixtures which occur, in particular, when conveying crude oil. To avoid these problems the natural gas present in the crude oil is first separated by compensators and after the pump it is fed in again via compressors. However, this process is very complicated and expensive.

SUMMARY OF THE INVENTION

The object of the present invention is, therefore, to provide a pump which has a simple construction and can be used to convey gas-liquid mixtures.

This object is achieved by providing a pump having an enclosed housing with an annular, inwardly facing surface inside and extending around the housing, a generally tubular eccentric extending inside and axially through the annular surface and disposed eccentric to the axis of the annular surface; a displacer adapted for radial displacement disposed between the annular surface and the eccentric and rotatable around the axis of the annular surface. There is a supply of a liquid gas mixture to be pumped and an outlet from the pump. The displacer selectively draws the mixture from the supply into the displacer and/or pump the mixture from the displacer as the radial space between the eccentric and the annular surface correspondingly changes in size. The annular surface may be connected with a shaft, particularly a hollow shaft, which rotates the annular surface and the shaft may, in turn, be rotated by a motor rotor or even may be part of the motor. The supply of liquid is through the eccentric. The eccentric has respective inlet and outlet chambers which respectively communicate with the displacer at different locations around the annular surface for receiving liquid mixture from the supply or for pumping it and out of the pump. Sealing arrangements for the displacers and various numbers of displacers are also disclosed. With the solution according to the invention so-called displacers are used, which each have a changeable volume displacer chamber. The displacers are arranged between an annular surface located radially inward and an eccentric arranged eccentrically to and radially outward of the annular surface. The annular surface, in addition to supporting the displacers, serves to hold the displacers in a fixed position on i.e. non-rotatable with respect to the annular surface, so that they can turn relative to the eccentric. During the turning, because of the eccentricity, the radial distance between the annular surface and eccentric, and accordingly also the volume of the displacer chambers, changes continuously.

With this arrangement it is possible to dispense completely with a cylinder block as the displacers are individual, independent parts which can be installed in a simple manner between the eccentric and annular surface. Furthermore, this design permits a compact and extremely space-saving construction.

According to an advantageous further development of the invention the annular surface is driven by a hollow shaft which, in addition, acts as medium supply. As a result thereof the supplied medium is also made to turn. The centrifugal force acting on the medium causes the specific lighter gas to collect in a middle section and the specific heavier liquid medium in an outer ring-shaped area. With the aid of this separation an optimal charging of the displacer chambers takes place and, accordingly, an extremely good conveying of such gas-liquid mixtures.

It is also advantageous to carry out the medium supply decentred, i.e. not via the drive shaft for the annular surface. Preferably, the medium is passed through an annular casing section which extends in the longitudinal direction of the housing and adjoins the stator of the pump motor. This has the advantage that the conveying capacity is increased and at the same time a cooling of the motor can be ensured by means of the conveyed medium. Furthermore, this decentred supply results in an additional soundproofing obtained by the screening effect of the annular casing section.

Naturally, the central medium supply via the hollow shaft can also be combined with the decentred supply.

According to a further advantageous embodiment of the invention the displacer is constructed in such a way that it is in friction contact with the annular surface. This makes it possible to hold the displacer against the annular surface without using additional holding means.

In an advantageous embodiment the displacer consists of a first movable displacer element resting against the eccentric and a second displacer element or piston resting against the annular surface, wherein the first displacer element can be moved radially to the annular surface. As a result of this telescope-like shifting of the two displacer elements relative to one another, the displacer volume is alternatingly increased and reduced during every rotation around the eccentric. The construction of such a displacer is very simple, so that it can be produced at a reasonable cost.

In another advantageous further development the displacer has a sealing element, which rests sealingly against the eccentric, wherein preferably a concave sealing shoe adapted to the outside surface of the eccentric is used. Also here an effective seal is produced between the displacer chamber and eccentric by very simple means and, accordingly, also at low cost. Preferably, the first and the second displacer elements are spring-loaded, so that the first displacer element is pressed against the eccentric and the second displacer element against the annular surface with a defined force.

In a further advantageous embodiment of the invention, a valve ring is provided between eccentric and displacer, in which case the displacers rest against the valve ring in a fixed position and the valve ring can rotate around the eccentric. As a result thereof the medium supply and discharge can be fashioned more freely without the need of being subject to an annular peripheral surface. All that needs to be ensured is that the valve ring is adequately supported.

In a further development the first displacer element is held against the valve ring in the radial direction, wherein preferably on at least two outside surfaces of the first displacer element grooves are provided, into which the lugs formed onto the valve ring can engage. With the aid of this design the installation can be simplified further and the centrifugal force acting on the second displacer element can be utilised to ensure that it is held properly against the annular surface without requiring an additional spring.

Preferably, several such valve rings are used which in the axial direction are arranged above one another and which preferably have different eccentricities. With this the conveying capacity can be increased in a very simple manner.

Preferably, the eccentric has an axial opening which adjoins an opening of the hollow shaft in such a way that the medium can flow into the eccentric. The peripheral surface of the eccentric is preferably provided with an outlet opening and an inlet opening, which normally lie opposite one another. The outlet opening is connected to the axial medium supply and the inlet opening to an also axial medium discharge. In this way a very simple medium supply can be realised.

Preferably, the medium supply as well as the medium discharge each have a non-return valve, so that the pump is also suitable for very high pressures.

In a further embodiment of the invention the hollow shaft is constructed as the rotor shaft of an electric motor, so that the medium to be conveyed flows axially through the motor. This construction is extremely compact and space-saving, and because of the axial throughflow of the medium the pump can be used directly in a pipe line.

Further advantageous embodiments can be noted from the sub-claims.

BRIEF DESCRIPTION OF THE DRAWINGS

The present invention will now be described in greater detail with reference to exemplified embodiments illustrated in the drawings, wherein:

FIG. 1 illustrates diagrammatically in longitudinal section a pump 1, wherein the parts that are not essential to the invention have been left out. The pump 1 consists of a long housing 3, the one longitudinal end of which is closed off by a removable cover 7. The other longitudinal end 9 of the housing 3 has a shaft opening 11 as well as a cup-shaped inlet filter 5 mounted onto the outside.

Figure 1:
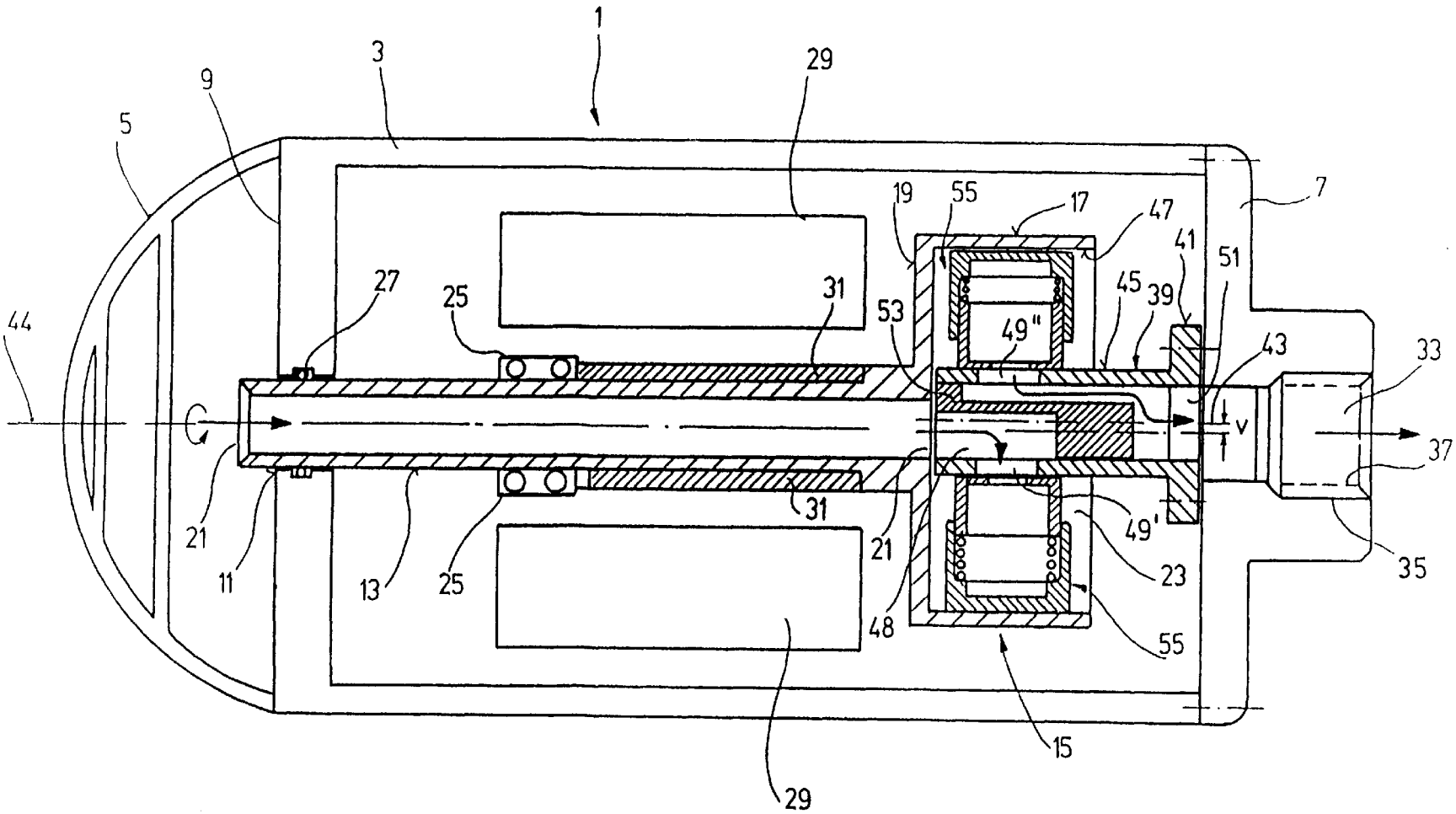
FIG. 1 shows a diagrammatic longitudinal section through a pump according to a first exemplified embodiment.

A shaft 13, which passes through the shaft opening 11, extends inside the housing 3 in the longitudinal direction, wherein inside the housing near the cover 7 the shaft 13 ends in a beaker-shaped section 15, the open side of which faces the cover 7. This beaker-shaped section 15 consists of an annular surface 17 which lies concentrically to the longitudinal axis of the shaft 13, and a radial surface 19 extending radially from the shaft 13 to the annular surface 17. The outside diameter of the beaker-shaped section 15 is, therefore, greater than the outside diameter of the shaft 13.

The shaft 13 itself is a hollow shaft with an opening 21 at each of its axial ends. This, therefore, provides a communication between the opening 21 of the shaft 13 facing the end face 9 and the space 23 enclosed by the annular surface 17.

The shaft 13 with its beaker-shaped section 15 is supported rotatably by bearings 25 arranged in the housing 3, which bearings for the sake of clarity have been shown in only one spot in the Figure. The other bearing required for a secure support preferably is positioned close to the beaker-shaped section 15.

The only shaft opening 11 in the housing 3 is provided with a sealing element 27, preferably an O-ring.

Inside the housing 3 an electric motor is provided which is indicated purely diagrammatically by the two rectangles 29, i.e. in the form of a black-box. This black-box 29 contains, for example, the stator windings, the electric supply lines as well as, for example, sliding contacts. The arrangement and construction of such an electric motor, preferably a direct-current motor, is known to the expert and therefore no further details will be given here. All that needs to be mentioned is that an armature winding 31 of the motor 29 forms part of the hollow shaft 13. The hollow shaft 13, therefore, not only acts as medium supply but also as a drive shaft.

The cover 7 connected to the housing 3 has a bore 33 which passes completely through the cover 7. The section 35 of the bore 33 pointing to the outside has a screw-thread 37 so that, for example, a not illustrated connection piece can be screwed in. An eccentric 39 is fastened with its flange-like end 41 to the inside of the cover 7, e.g. by screws. To ensure a scaling, O-rings can, for example, be used here—not illustrated in the drawing.

In the present exemplified embodiment the eccentric 39 is circular, wherein its longitudinal axis does not coincide with the longitudinal axis of the hollow shaft 13 and of the beaker-shaped section 15. The longitudinal axis 43 of the eccentric 39 is offset relative to the longitudinal axis 44 of the hollow shaft 13 by an amount v.

Because of this eccentric arrangement the distance—seen in the peripheral direction—between the outside peripheral surface 45 of the eccentric 39 and the inside annular surface 47 changes continuously.

The end of the eccentric 39 positioned opposite the flange 41 lies very close against the radial surface 19, the opening 21 of the hollow shaft 13 being covered completely. In this end of the eccentric 39 an axial bore, preferably a blind hole 48, is provided which co-operates with the opening 21.

By means of a radial bore 49' in the peripheral surface 45 of the eccentric 39 a further communication is created between the axial bore 48 to the outside.

At the opposite end of the eccentric another axial bore 51 is provided, which co-operates with the inside opening of the bore 33 in the cover 7. The peripheral surface 45 of the eccentric 39 is again provided with a further bore 49", which creates a communication between the axial bore 51 and the annular space 23.

Between the axial bore 48 and the axial bore 51 lies a wall section 53 which ensures a separation of these bores.

In the present exemplified embodiment the radial bore 49' acts as outlet opening and the radial bore 49" as inlet opening. Because the flow passes through these openings from one side only, an optimal flow favorable shape can be chosen.

Between the inside annular surface 47 and the outside peripheral surface 45 of the eccentric 39, displacers 55 are arranged, two of which displacers are shown in FIG. 1. Preferably, however, three or more displacers are used, the number of displacers influencing the uniformity of the conveying.

In the following such a displacer 55 will be described in greater detail with reference to FIG. 4.

The displacer 55 with a preferably circular cross-section consists of a first displacer element 57 and a second displacer element or piston 59. The first displacer element 57 is provided at its end facing the eccentric with a sealing shoe 61, the outline of which is adapted to that of the outside peripheral surface 45 of the eccentric 39, so that a tight seal is ensured.

The second displacer element 59 is positioned movably on the end of the first displacer element 57 opposite to the one with the sealing shoe 61, a displacer chamber 63 being formed between the first and second displacer elements.

Inside the first displacer element 57 there extends a duct 65 which begins at the sealing shoe 61 and opens out in the displacer chamber 63.

Inside this displacer chamber 63 a spring 67 is arranged, which in turn rests on an inside wall of the second displacer element 59 and an opposite wall section of the first displacer element 57. This spring 67 ensures that the second displacer element 59 is pressed against the annular surface 17 with a force determined by the spring.

This end 69 of the second displacer element 59 adjoining the annular surface 17 is arc-shaped or cup-shaped, its radius being smaller than that of the annular surface 17. At the highest point of this cup-shaped end 69 a point-shaped lug 21 is provided, which alone is in contact with the annular surface 17.

However, also other shapes of the end 69 adapted to the annular surface 17 are possible.

The sealing off of the dispenser chamber 63 from the annular space 23 takes place by a sealing ring 73 which is located in the peripheral surface of the first displacer element 57 and rests against the inside wall surface 74 of the second displacer element 59.

From FIG. 1 it can be noted that the opening of the duct 65 facing the eccentric 39 (see FIG. 4) co-operates with the openings 49' and 49" respectively, so that the medium flowing into the axial bore 48 can flow through the bore 49' into the displacer chamber 63 of the bottom displacer 55, and the medium in the displacer chamber 63 of the top displacer 55 can flow through the bore 49" and the bore 33 to the outside.

In the following the mode of functioning of the pump illustrated in FIG. 1 will be explained.

The electric motor 29 drives the hollow shaft 13 and accordingly also the annular surface 17. This annular surface 17 holds the displacers 55 and accordingly moves them along, so that they also move along a circular path. A suitable possibility for taking the displacers 55 along consists in providing friction contact between the annular surface 17 and the end of the second displacer element 69, preferably the point-shaped lug 71. It must be ensured here that the static friction force occurring on the annular surface 17 is greater than that between the sealing shoe 61 and eccentric surface 45. Otherwise the annular surface will slip over the displacer so that it does not experience any movement in relation to the eccentric.

Naturally, also other possibilities for taking the displacers along are conceivable, for example by stops provided on the inside annular surface 47.

By the annular surface 17, which in accordance with the foregoing acts as a drive, the displacers 55 are turned around the eccentric, the first displacer element 57 turning around the eccentric axis 45 and the second displacer element 59 around the longitudinal axis 44 of the hollow shaft. Because of the eccentricity of the two axes 44, 45, during a rotation the two displacer elements 57, 59 are pushed into one another in a telescope-like manner against the force of the spring 67, as a result of which the space-volume of the displacer chamber 63 changes.

Figure 4:
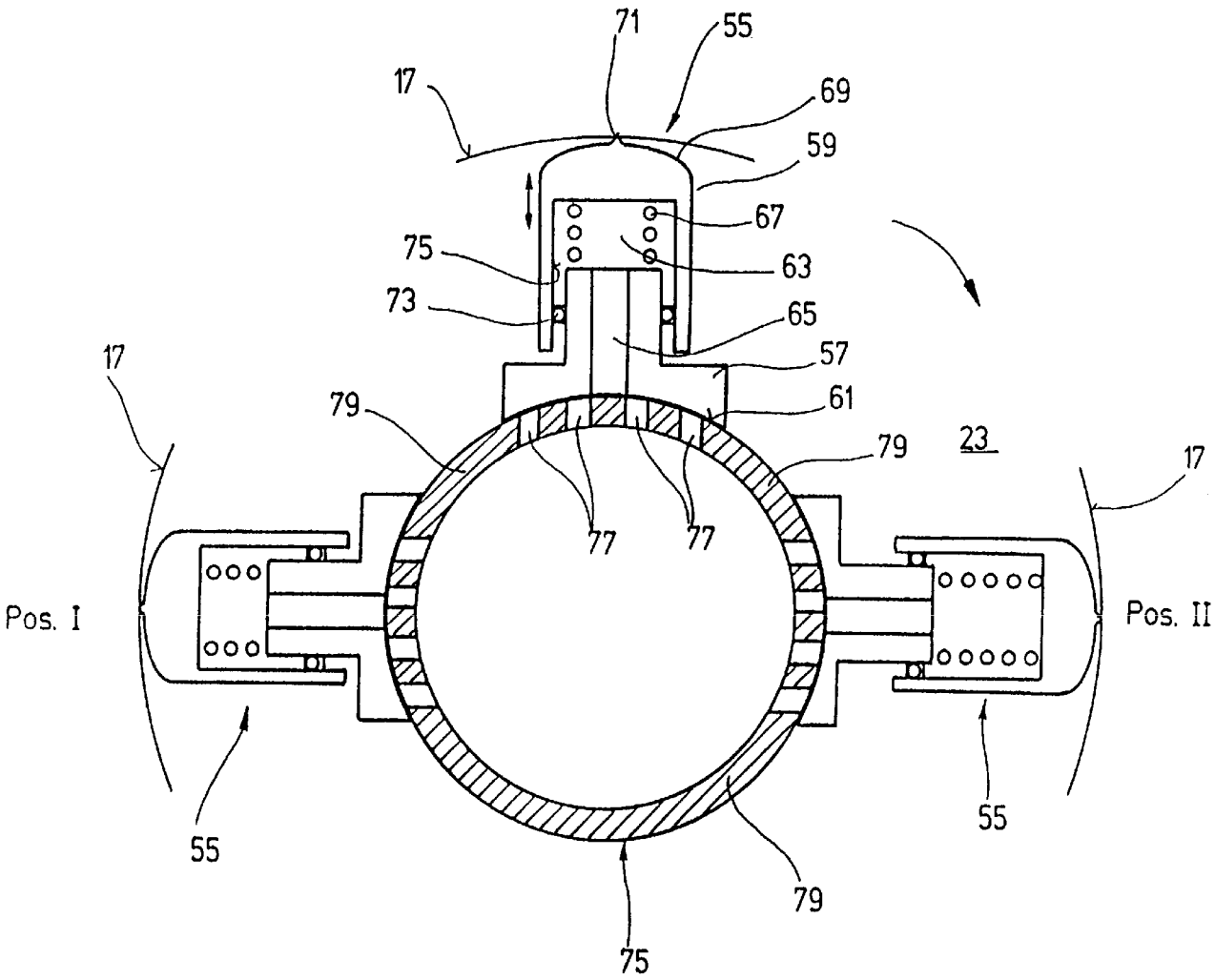
FIG. 4 is a diagrammatic view of several displacers.

FIG. 4 shows, by way of example, two positions I and II, the displacer chamber 63 having the smallest space-volume in position I and the largest space-volume in position II.

When the displacers 55 in this Figure are moved along in a clockwise direction, the space-volume of the displacer chamber 63 will increase continuously from position I up to position II, to then again decrease continuously back to position I. The movement time from position I to position II is referred to as the suction phase and the movement time from position II to position I as the expelling phase.

Getting back to FIG. 1, the medium to be conveyed, e.g. a mixture of natural gas and crude oil, flows through the filter 5 through the opening 21 into the hollow shaft 13. Because of the turning of the hollow shaft 13, the conveyed mixture also starts to turn when, due to the centrifugal force, the heavier crude oil flows through an outer section of the hollow shaft 13, whereas the lighter natural gas is conveyed through in a middle section of the hollow shaft 13.

This flow at the end of the hollow shaft 13 now flows through the opening 21 into the bore 48. Next, the heavier liquid first flows through the bore 49' into the displacer chamber 63. Because of the suction effect of the increasing space-volume during the suction phase, this flowing-in is helped along or realised.

As soon as the displacer element 55 has reached the end of the suction phase, i.e. position II, the connection to the bore 48 and accordingly to the suction side of the pump is interrupted.

Shortly afterwards, during the expelling phase, the displacer element 55 comes into the operating range of the opening 49", as a result of which a connection is created to the outside side of the pump (here the bore 33). Because of the reducing space-volume of the displacer chamber 63 during the expelling phase, the medium present in this chamber is expelled.

The turning of the hollow shaft 13 ensures that during every suction phase liquid gets into the displacer chamber 63 of a displacer 55, so that the pump will never run dry.

As in the exemplified embodiment illustrated in FIG. 1 no non-return valve is provided in the axial bore 51 which serves as outlet, it must be ensured that a displacer element 55 co-operates continually with the opening 49" or seals same off, respectively. A suitable possibility consists, for example, in designing the sealing shoes 61 of the displacer elements in such a way that together they engage around the entire periphery of the eccentric 39. If, therefore, for example three displacer elements are used, their sealing shoes 61 will each cover a peripheral area of 120°.

It is also possible, of course, to use more than three displacers 55, in which case in each instance also several bores 49' and 49" can be provided.

Another possibility to ensure a sealing of the bores 49 and a connection to the displacer elements 55, respectively, consists in using a valve ring 75, as indicated diagrammatically in FIG. 4. This valve ring 75 completely surrounds the eccentric 39 in its axial section where the bores 49 are provided. Bores 77 provided in the valve ring create a connection from the inside of the eccentric to the outside into the displacers 55.

With this exemplified embodiment the sealing shoes 61 no longer slide over the peripheral surface of the eccentric, but are arranged essentially in a fixed position in relation to the valve ring. The fixing into position of the sealing shoes 61 on the valve ring 75 during the rotating can again be ensured by, for example, friction contact or stops, in which case the annular surface 17 drives not only the displacers 55 but also the valve ring 75.

The sealing of the bores 49 between two adjacent displacers 55 takes place in this case not by the sealing shoes 61 but by means of sealing sections 79 in the valve ring. For the rest the mode of functioning of this arrangement corresponds to that already described with reference to FIG. 1, so that a further explanation can be dispensed with.

Figure 2:
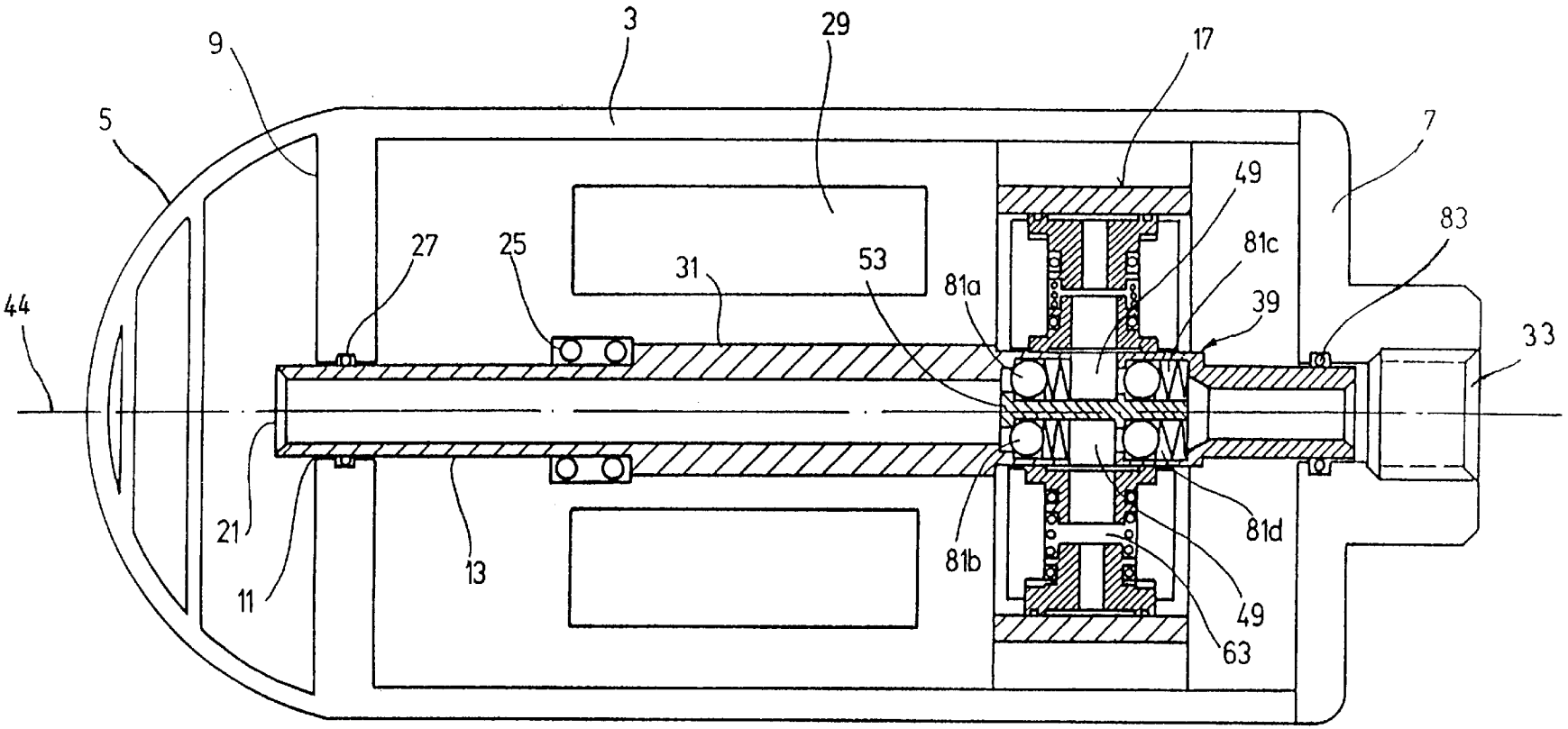
FIG. 2 shows a diagrammatic longitudinal section through a pump of a second exemplified embodiment.

The other exemplified embodiment illustrated in FIG. 2 differs from the one shown in FIG. 1 among others in that non-return valves 81 are provided in the eccentric 39. The non-return valves 81*a* and 81*b* arranged on the suction side prevent the medium expelled from the displacer chamber 63 from flowing back again into the hollow shaft 13, but ensure that via the non-return valves 81*c* and 81*d* which act opposite to the non-return valves 81*a* and 81*b* it can flow to the bore 33. The bores 49 are used as outlet as well as inlet openings, in contrast to the openings 49 of FIG. 1 through which the medium flows from only one side.

Another difference compared to the pump illustrated in FIG. 1 is that the annular surface 17 is arranged in a fixed position in relation to the housing 3. The eccentric 39, on the other hand, rotates around the longitudinal axis of the hollow shaft 13. This is achieved in that the eccentric is constructed as an eccentric section of the hollow shaft 13, the end of which on the side of the cover being mounted centrally in a bore of the cover 7. The rotationally tight sealing off to the outside takes place, for example, by an O-ring 83.

To obtain a change in the space-volume of the displacer chamber 63, the eccentric section 39 must execute a relative movement in relation to the displacer 55, so that as a result of the eccentricity a continuous change in the distance between annular surface and peripheral surface of the eccentric takes place. As a result, also here the sealing shoe 61 slides over the peripheral surface of the eccentric, as has already been described in connection with the FIGS. 1 and 4.

For the rest the mode of functioning of this pump corresponds to the one already described in connection with the exemplified embodiment of FIG. 1. For this reason another explanation is dispensed with.

Figure 3:
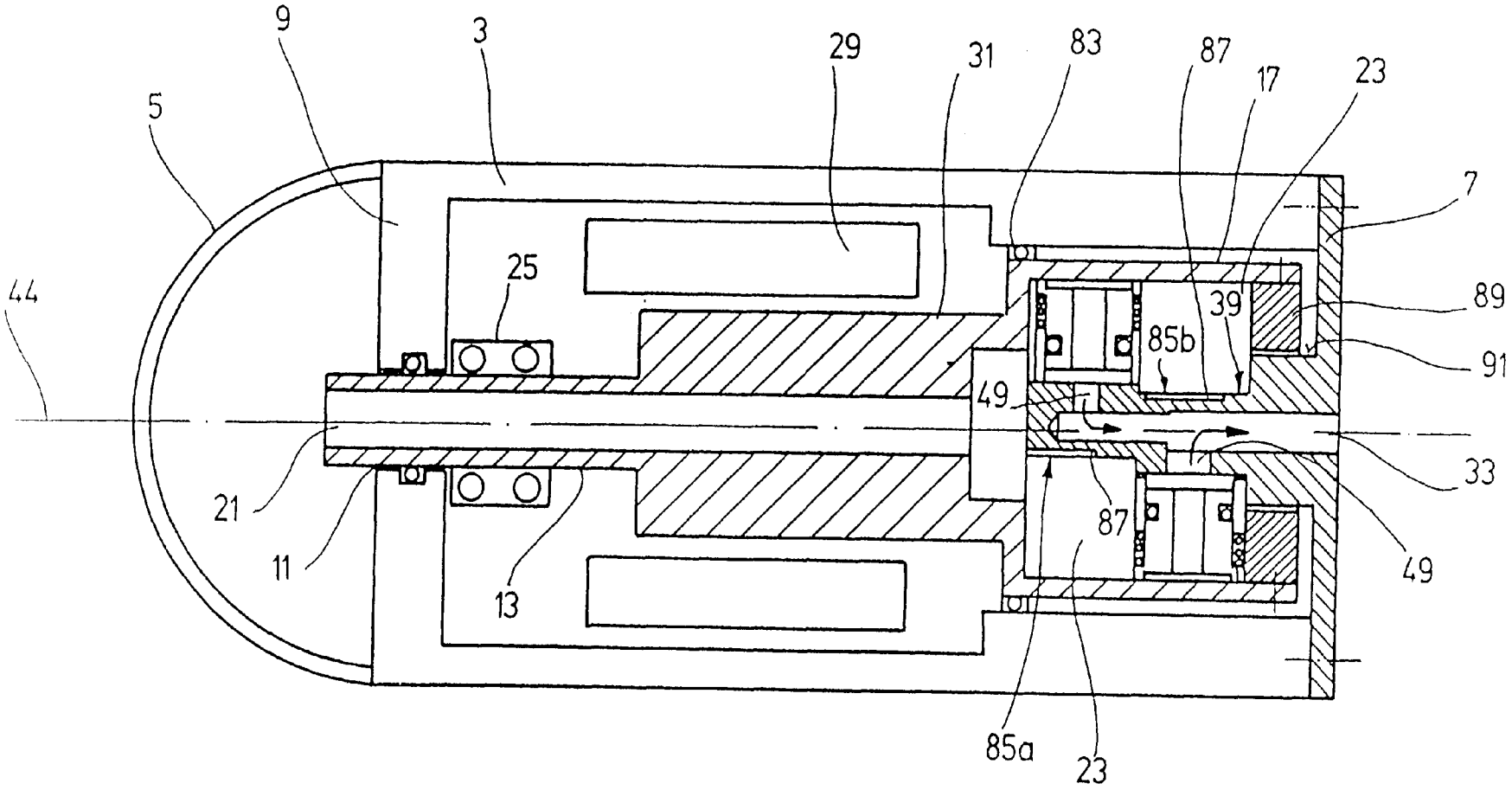
FIG. 3 is a longitudinal section through the pump of a third exemplified embodiment.

FIG. 3 illustrates another embodiment of the pump shown in FIG. 1.

This exemplified embodiment essentially corresponds to the one shown in FIG. 1, for which reason another description of the parts that bear the same reference numerals will be dispensed with.

The only difference is that the displacer elements are arranged in two parallel planes that are offset in the longitudinal direction of the hollow shaft 13. Each of these planes has an eccentric section 85*a* and 85*b*, respectively, which form part of the eccentric 39 but have different eccentricities in relation to the longitudinal axis 44.

Furthermore, no axial bore corresponding to the bore 48 is provided in the eccentric 39. The medium supply takes place through inlet pockets 87 which create a connection between the displacer chamber 63 and the annular space 23 filled with the medium. The sealing off of this annular space 23 from the inside of the housing takes place by a ring 89 resting radially against the annular surface 17, which ring 89 is supported in a sliding member on an area 91 of the cover 7 arranged concentrically to the longitudinal axis 44.

As already explained with reference to FIG. 1, also in this case it must be ensured that the radial bores 49 that are in communication with the bore 33 do not come in contact with the annular space 23. This can either be done by a suitable shaping of the sealing shoes or by the use of valve rings for every eccentric section, or by installing a non-return valve in the bore 33 or in the down-stream pressure line, respectively.

For the rest the mode of functioning corresponds to the one already described.

FIG. 5 shows a further possibility for the construction of a displacer element 55. This one also consists of a first displacer element 57 and a second displacer element 59. However, in this case the second displacer element 59 engages into the first displacer element 57.

In contrast to the displacer 55 shown in FIG. 4, this exemplified embodiment does not have a spring 67. Here the centrifugal force of the rotating displacer 55 directed towards the annular surface 10 is used to press the second displacer element 59 against the annular surface 10. To prevent that the first displacer element 57 is also moved towards the annular surface 17 by the centrifugal force, a forced guidance acting in the radial direction is provided between this first displacer element 57 and the valve ring 75. The forced guidance 93 is designed in such a way that a suitable lug 97 of the valve ring 75 engages into grooves 95 provided on at least two peripheral sides of the first displacer element 57.

Figure 5B:
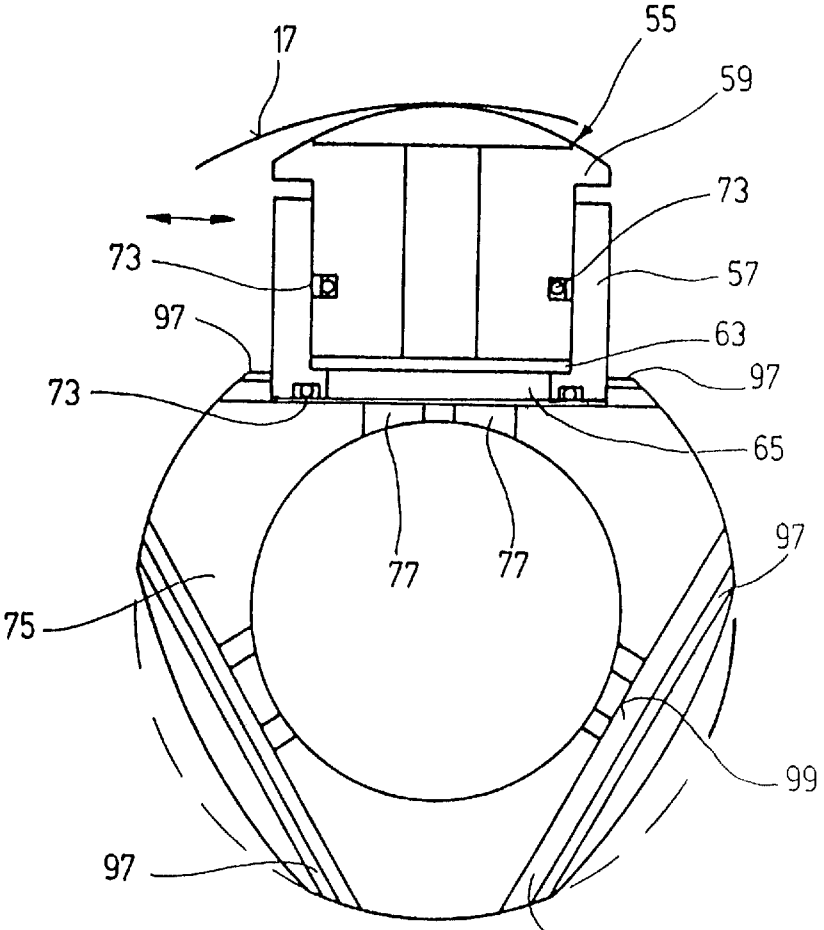
FIGS. 5*a* and *b* show another exemplified embodiment of a displacer.
Figure 5A:
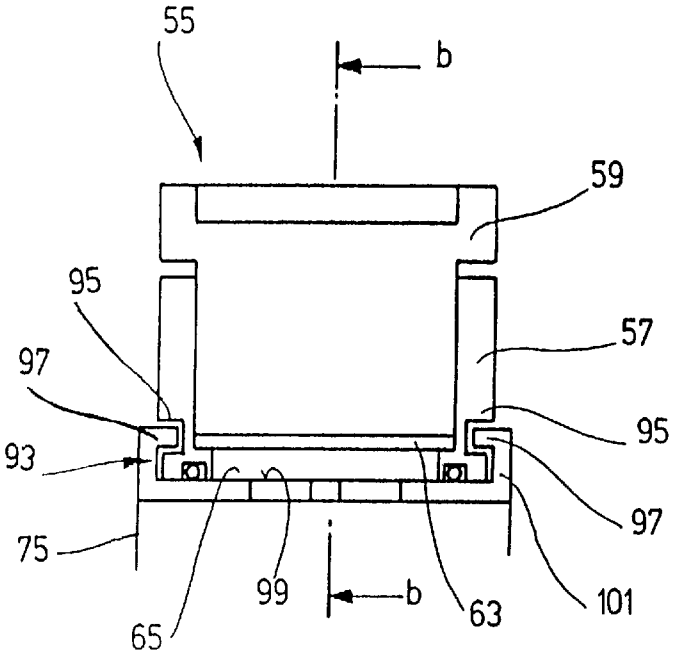

In the section along the line b—b in FIG. 5*a,* which is shown in FIG. 5*b,* the entire valve ring 75 is shown. From this it can be seen that it has flat surfaces 99 above which side walls 101 project on two opposite sides, which in turn have lugs 97. However, as a result of the already described forced guidance of the displacer element 55, a shifting parallel to the side wall 101 is possible, as indicated by the double arrow in FIG. 5*b*.

For the rest mode of functioning of this valve ring corresponds to that of the valve ring already described with reference to FIG. 4.

Figure 6:
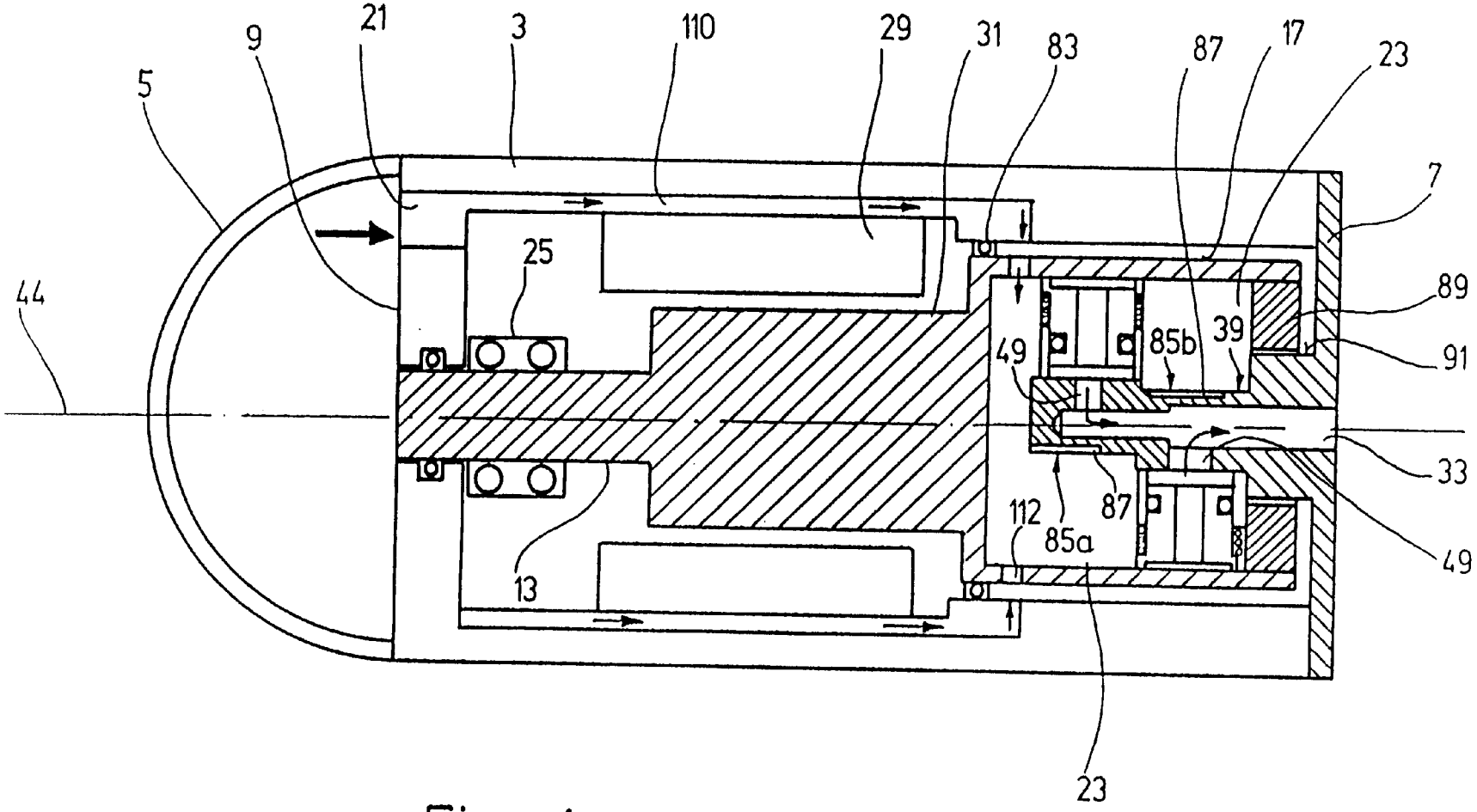
FIG. 6 is a longitudinal section through the pump of a fourth exemplified embodiment.

FIG. 6 shows another embodiment of the pump illustrated in FIG. 1.

As this exemplified embodiment essentially corresponds to the one shown in FIG. 3, another description of the parts bearing the same reference numerals is dispensed with.

With the pump shown in FIG. 6 the only difference is that the medium supply does not take place centrally via the drive shaft 13, but decentred via an annular casing section 110.

This annular casing section 110 extends from the end face 9 of the pump housing up to the annular surface 17, passing directly along the stator of the pump motor. A bore 21 is provided in the end face 9 of the housing through which the medium to be conveyed can enter the annular section 110. Naturally, also several such bores 21 may be provided.

At the opposite end of the annular section 110, a radially inwards extending connection 112 is formed through the annular surface 17 into the space 23. The connection 112 may be provided in the form of bores or openings distributed over the periphery of the annular surface 17. Naturally the filling of the space 23 with the medium to be conveyed can also take place axially in the area of the ring 89.

Therefore, compared to the pump shown in FIG. 3, the medium is fed in not centrally via a hollow shaft 21, but decentred via the annular section 110 into the space 23.

However, the actual mode of functioning of the conveying does not change as a result thereof.

Figure 7:
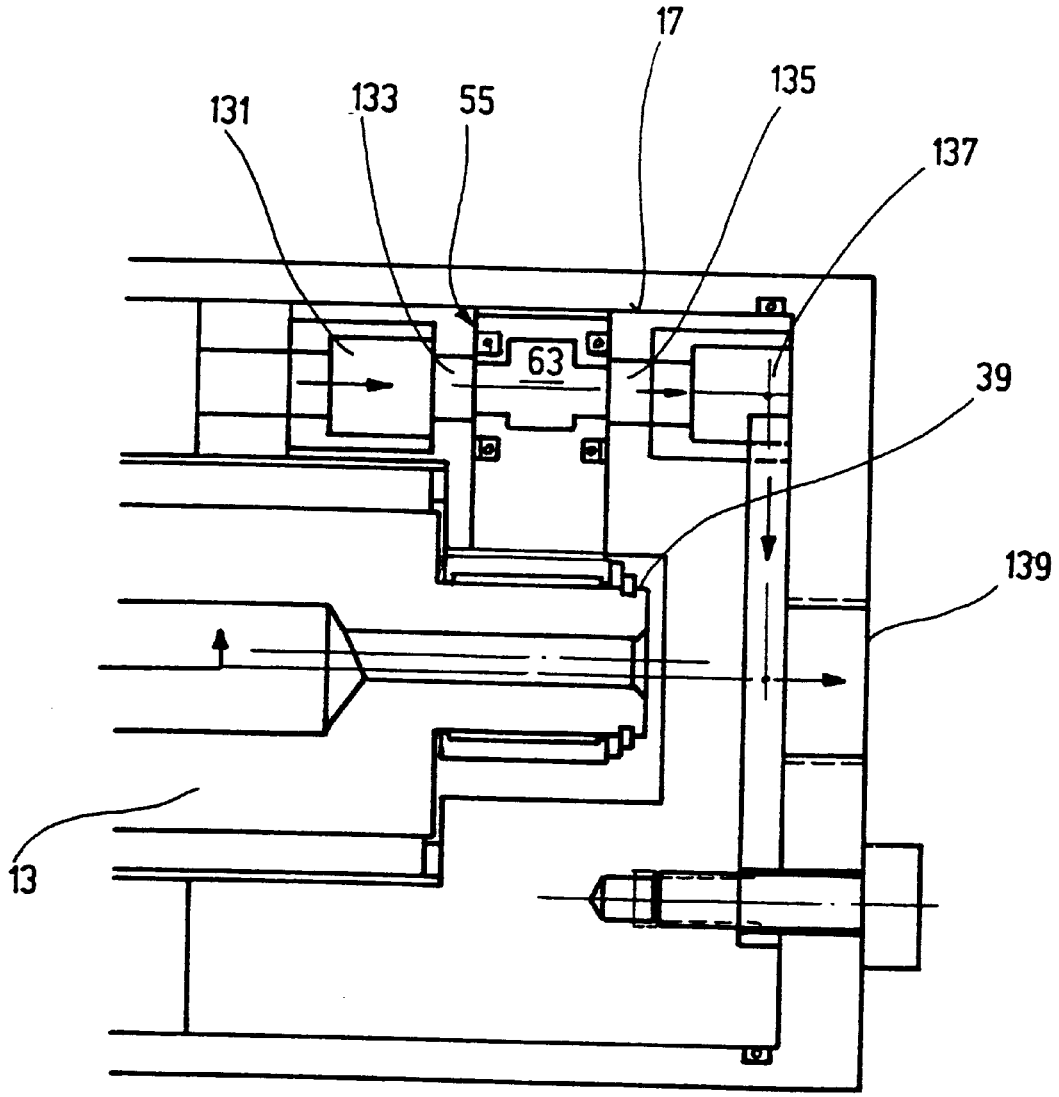
FIG. 7 is a diagrammatic longitudinal section through the pump of a fifth exemplified embodiment.

FIG. 7 shows another exemplified embodiment of a pump, which essentially corresponds to the one illustrated in FIG. 2. Also here the annular surface 17 is arranged in a fixed position, whilst the eccentric 39 turns and ensures the stroke movement of the displacer 55.

The only difference is that the medium supply is different. The medium flows, as before, through the hollow shaft 13, but then—as indicated by an arrow—is deflected radially outwards into an inlet area 131. From there it flows into the displacer chamber 63, passing beforehand through an only diagrammatically indicated non-return valve 133. During the expelling of the medium from the displacer chamber 63 an also only diagrammatically indicated non-return valve 135 opens, so that a flow path is opened into an outlet area 137.

FIG. 7 clearly shows that the medium supply takes place parallel to the hollow shaft and transversely to the longitudinal axis of the displacer 55 at least between the inlet area 131 and the outlet area 137.

From the outlet area 137 the medium flows preferably radially inwards and then through a central bore 139 to the outside.

The pumps mentioned in the foregoing can be used in many ways. They can, for example, be used as borehole pump because of their good properties regarding the conveying of gas-liquid mixtures, However, the mentioned exemplified embodiments can also be used as circulating pumps in heating systems or as injection pumps in the medical field. These pumps can even be used for high pressure applications, in which case, for reasons of safety, non-return valves must, however, be provided in the inlet and outlet ducts.

However, at very high pressures a slot control without valves, as illustrated for example in FIG. 1 or 3, is preferred.

It must be mentioned once again here that by reversing the medium flows, the described pumps can also be used as motors.

For the rest individual features of the mentioned exemplified embodiments may be combined in any way.

I claim:

1. A pump for conveying a liquid with mixed gas, the pump comprising a hollow external housing;

a rotatable annular, inwardly facing drive surface extending around and inside the housing;

a generally static and tubular eccentric extending inside and axially through the annular surface and disposed eccentric to the axis of the annular surface;

a displacer adapted for radial displacement and disposed between the rotatable annular surface and the static eccentric, the displacer being rotatable relative to the eccentric and being rotated by the rotatable annular, inwardly facing drive surface around the axis of the annular surface; the displacer is rotatively fixed relative to and rotates along with the annular surface, the displacer is rotatable with respect to the eccentric, and the annular surface is rotatable around and relative to the eccentric;

a supply of liquid gas mixture to the pump, an outlet for pumped mixture from the pump; the supply of the mixture comprises a hollow shaft which is located in the housing for delivering the mixture to the displacer, and the shaft is rotatable and is connected with the annular surface for rotating together with the annular surface;

the eccentric includes an axial opening communicating with the hollow shaft for receiving mixture flowing axially into the eccentric from the hollow shaft, and the axial opening of the eccentric communicating with the displacer for supplying mixture to the displacer;

the displacer communicating with at least one of the supply and the outlet for the mixture, for selectively drawing the mixture from the supply into the displacer as the radial space between the eccentric and the annular surface increases and for pumping the mixture from the displacer through the outlet as the radial space between the eccentric and the annular surface decreases.

2. The pump of claim 1, wherein the displacer is in friction contact with the annular surface to be in a fixed position with respect to the annular surface.

3. The pump of claim 1, wherein the eccentric has a peripheral surface;

an outlet opening through the peripheral surface from the axial opening in the eccentric and communicating to the displacer; an inlet opening through the peripheral surface and into the axial opening of the eccentric; and means in the axial opening for separating the inlet and the outlet openings to the eccentric;

another opening from the housing located downstream from the inlet opening; the displacer being constructed such that rotation of the displacer around the eccentric selectively draws liquid into the displacer through the outlet opening from the eccentric leading into the displacer when the radial space between the annular surface and the peripheral surface of the eccentric is increasing and dispenses liquid from the displacer through the inlet opening to the other opening downstream when the radial space between the annular surface and the peripheral surface of the eccentric is decreasing.

4. The pump of claim 3, wherein at least one of the outlet opening and the inlet opening includes a non-return valve permitting flow in only one direction, such that the outlet opening will permit flow outward through the peripheral surface and the inlet opening will permit flow inward through the peripheral surface.

5. The pump of claim 1, further comprising an electric motor in the housing, the hollow shaft comprises a rotor of the motor, and the hollow shaft having armature windings thereon to serve as the motor rotor.

6. The pump of claim 1, further comprising a section of the housing located outward of the shaft and serving as the medium supply to the displacer.

7. The pump of claim 1, wherein the displacer is freely rotatable with respect to the eccentric.

8. The pump of claim 1, wherein the displacer comprises a first dispenser element which travels over the eccentric to be moved radially with respect to the annular surface as the first displacer element rotates around the eccentric; and a second displacer element circumferentially and axially at the first displacer element, and resting against the annular surface and radially movable with reference to the first displacer element as they rotate around the eccentric; the first and second displacer elements being shaped for defining a chamber within the displacer which increases an internal volume as the second displacer element moves radially outward and decreases in internal volume as the second displacer element moves radially inward.

9. The pump of claim 8, wherein the displacer includes a sealing element which rests sealingly against the eccentric and cooperates with the first displacer element.

10. The pump of claim 9, wherein the sealing element comprises a sealing shoe around the eccentric which is concavely shaped to the eccentric.

11. The pump of claim 9, further comprising a valve ring around the eccentric, bores through the valve ring communicating from the eccentric into the displacer for enabling the mixture to pass between the eccentric and the displacer, the sealing element of the displacer resting upon the valve ring and being rotatable with the valve ring.

12. The pump of claim 11, wherein the first displacer element is held in the radial direction on the valve ring.

13. The pump of claim 11, further comprising a groove defined in one of the first displacer element and the valve ring at the first displacer element, and a lug insertable into the groove located on the other of the first displacer element and the valve ring at the first displacer element, such that engagement between the lug and the groove holds the first displacer element in the radial direction of the valve ring.

14. The pump of claim 11, further comprising a groove defined in the first displacer element and a lug defined on the valve ring and the lug engaging in the groove for holding the first displacer element in the radial direction of the valve ring.

15. The pump of claim 8, further comprising a spring between the first and second displacer elements normally urging the second displacer element against the annular surface.

16. The pump of claim 1, wherein there are a plurality of the displacers arrayed around the eccentric.

17. The pump of claim 16, wherein the plurality of displacers are arranged in one transverse plane through the eccentric.

18. The pump of claim 1, further comprising a cover sealing off the housing and connected to the eccentric.

19. The pump of claim 1, further comprising a plurality of the displacers on the eccentric array in several planes transverse to the axis of the eccentric.

20. The pump of claim 19, wherein the eccentric includes a plurality of eccentric sections therealong having different eccentricities relative to the axis of the annular surface and each of the different eccentricities being at a respective one of the plurality of the spacers at a respective plane.

* * * * *